US010309080B2

(12) United States Patent
Sewell

(10) Patent No.: US 10,309,080 B2
(45) Date of Patent: Jun. 4, 2019

(54) TRENCH FILLING MACHINE

(75) Inventor: Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 580 days.

(21) Appl. No.: 13/540,236

(22) Filed: Jul. 2, 2012

(65) Prior Publication Data

US 2014/0144051 A1 May 29, 2014

Related U.S. Application Data

(60) Provisional application No. 61/537,790, filed on Sep. 22, 2011.

(51) Int. Cl.
*E02F 5/22* (2006.01)

(52) U.S. Cl.
CPC ..... *E02F 5/223* (2013.01)

(58) Field of Classification Search
CPC ..... E01C 19/209; E01C 19/48; E01C 19/15; E01C 19/12; E01C 19/002; E01C 19/065; E01C 19/20; E01C 19/201; E02F 5/223; E02F 5/22; E02F 5/226
USPC ..... 404/107, 108, 110, 111, 104; 37/142.5
See application file for complete search history.

(56) References Cited

U.S. PATENT DOCUMENTS 2,089,094 A 8/1937 Kime
3,109,351 A * 11/1963 Dunn ..... E01C 19/15 404/104
3,198,495 A * 8/1965 Maxon, Jr. ..... B28C 5/4244 298/22 R
3,331,519 A * 7/1967 Jennings, Jr. ..... B60P 1/40 414/489
3,402,816 A * 9/1968 Taylor ..... 209/260
3,439,806 A * 4/1969 Kass et al. ..... 209/260
3,552,346 A * 1/1971 Garden ..... B65B 1/08 141/313
3,849,017 A 11/1974 Rochfort
3,877,830 A 4/1975 James
4,071,226 A * 1/1978 Miller ..... A01C 15/003 366/35
4,319,859 A * 3/1982 Wise ..... 405/268
4,377,365 A * 3/1983 Layh ..... 414/334
4,383,651 A 5/1983 Couperus
4,492,490 A * 1/1985 Christine ..... E01C 23/06 296/183.2
4,496,265 A * 1/1985 Fragale ..... 404/110
(Continued)

FOREIGN PATENT DOCUMENTS

GB 1380398 A 1/1975

OTHER PUBLICATIONS

European Patent Office, "Supplementary European Search Report", dated Jul. 10, 2015, 2 pages, Munich.

*Primary Examiner* — Jessica H Lutz
(74) *Attorney, Agent, or Firm* — Tomlinson McKinstry, P.C.

(57) ABSTRACT

A machine for filling a trench comprises a tub, release assembly, and a hopper. The tub mixes a material to be filled into the trench. The release assembly releases the material into the hopper and the material flows from the hopper and into the trench. The machine moves parallel to the trench as the trench is being filled. An operator controls the movement of the machine from an operator station on the machine.

14 Claims, 6 Drawing Sheets

(56) References Cited

U.S. PATENT DOCUMENTS 4,507,012 A * 3/1985 Corcoran ..... E01C 19/4853 404/110
4,522,341 A * 6/1985 Wall ..... E01C 19/201 239/672
4,571,119 A * 2/1986 Jones ..... E01C 19/482 404/103
4,695,186 A * 9/1987 King ..... E01C 19/08 126/343.5 A
4,806,043 A 2/1989 Fournier
4,830,533 A 5/1989 Miller
4,831,958 A * 5/1989 Selby ..... 118/108
4,900,185 A * 2/1990 Foertsch ..... E01C 23/06 404/104
4,914,840 A 4/1990 Porter
5,120,217 A * 6/1992 O'Brien ..... E01C 19/1004 126/343.5 R
5,158,394 A * 10/1992 Bresnahan ..... 404/108
RE34,289 E * 6/1993 McClain et al. ..... 209/421
5,297,497 A 3/1994 Schmidt
5,427,470 A 6/1995 McKim
5,431,233 A 7/1995 Schmidt
5,573,347 A 11/1996 Miles
5,846,022 A 12/1998 Grundl
5,848,871 A * 12/1998 Thiessen ..... B65G 65/46 414/607
5,864,971 A * 2/1999 Jones ..... 37/410
5,873,396 A * 2/1999 Biebrach ..... E01H 10/00 141/10
5,988,935 A * 11/1999 Dillingham ..... 404/79
6,012,870 A * 1/2000 Dillingham ..... 404/79
6,050,744 A 4/2000 Binning
6,055,750 A 5/2000 Yoder
6,089,785 A * 7/2000 Bergman ..... E01C 23/06 404/101
6,213,680 B1 * 4/2001 Schaeffer et al. ..... 404/92
6,283,697 B1 * 9/2001 Pierce et al. ..... 414/504
6,345,931 B1 * 2/2002 Capece ..... 404/101
6,439,806 B1 * 8/2002 Dillingham ..... 404/95
6,508,606 B1 * 1/2003 James et al. ..... 404/98
6,558,079 B1 * 5/2003 Kozak et al. ..... 405/129.15
6,612,774 B1 * 9/2003 Dulin ..... E01C 19/266 404/104
6,659,376 B2 * 12/2003 Savard ..... E01C 19/482 239/650
6,763,925 B2 * 7/2004 Woods ..... 198/311
6,830,412 B2 12/2004 Perez
6,966,725 B2 11/2005 Cochran
7,255,512 B2 8/2007 Wallace
7,377,719 B1 * 5/2008 Elizondo et al. ..... 404/98
7,441,987 B1 * 10/2008 Sampey ..... 404/98
7,488,149 B2 2/2009 Waldner
7,510,365 B2 * 3/2009 Babiarz ..... E02F 3/3414 37/903
7,581,339 B2 * 9/2009 Mizoroke et al. ..... 37/234
7,716,773 B1 5/2010 Pahl
7,784,996 B1 * 8/2010 Cummer ..... B28C 7/064 366/186
7,886,463 B2 * 2/2011 Greenberg et al. ..... 37/142.5
7,959,697 B2 * 6/2011 Francis ..... 55/385.1
8,016,516 B2 * 9/2011 Johnson et al. ..... 404/108
8,272,493 B1 9/2012 Grengs
8,308,394 B2 * 11/2012 Whitley ..... 404/75
8,465,225 B2 * 6/2013 Groulx et al. ..... 404/95
8,562,249 B2 * 10/2013 Owegeser ..... 404/108
8,573,886 B1 11/2013 Taylor
8,888,403 B2 11/2014 Atherton
9,102,460 B2 * 8/2015 Pylinski ..... B28C 7/161
9,714,498 B1 * 7/2017 Bucher ..... E02F 3/7622
9,816,236 B2 * 11/2017 Loomis ..... E01C 23/0973
D823,903 S * 7/2018 Guilmette ..... D15/28
2002/0044830 A1 4/2002 Munie
2002/0060125 A1 * 5/2002 Woods ..... B65G 69/0408 198/311
2003/0215288 A1 * 11/2003 Causie et al. ..... 404/104
2006/0002762 A1 * 1/2006 Crampton ..... E01C 19/15 404/110
2009/0035110 A1 2/2009 Woods
2012/0126023 A1 * 5/2012 Cantin ..... E01C 19/2045 239/1
2014/0105683 A1 4/2014 McKinnon
2014/0377002 A1 12/2014 Seever
2017/0051460 A1 * 2/2017 Guilmette ..... E01C 19/4866

* cited by examiner

TRENCH FILLING MACHINE

CROSS REFERENCE TO RELATED APPLICATION

This application claims the benefit of provisional patent application Ser. No. 61/537,790 filed on Sep. 22, 2011, the entire contents of which are incorporated herein by reference.

FIELD OF THE INVENTION

The present invention relates generally to the field of filling a trench, and in particular to trench filling machines for micro-trenches.

SUMMARY OF THE INVENTION

The present invention is directed to a trench filling machine. The machine comprises a frame, a motive means for moving the frame, a tub supported on the frame, a release assembly, a hopper, and a discharge conduit. The release assembly is disposed on the tub and comprises a spout and a door. The hopper is supported on the frame and is positioned below the release assembly. The discharge conduit is disposed on the hopper to feed material into a trench.

The present invention is also directed to a release assembly for use with a trench filling machine. The trench filling machine comprises a tub and a hopper. The release assembly comprises a gate plate attached to a first end of the tub, a horizontal link pivotally connected at a first end to the gate plate, a vertical link connected to a second end of the horizontal link, a door, and a spout. The door is movable up and down via movement of the horizontal and the vertical link.

The present invention is further directed to a method for filling a trench using a trench filling machine. The method comprises the steps of mixing a material within a tub using a plurality of blades connected to a shaft, positioning the trench filling machine parallel to the trench, wherein a hopper comprising a discharge conduit connected to the trench filling machine is placed above the trench, and lowering the hopper so a portion of the discharge conduit is placed within the trench. The method also comprises the steps of lifting a door on a release assembly connected to the tub to release the material from the tub into the hopper, and vibrating the hopper so the materials flow from the hopper through the discharge conduit and into the trench.

DESCRIPTION OF THE PREFERRED EMBODIMENT

Figure 1:
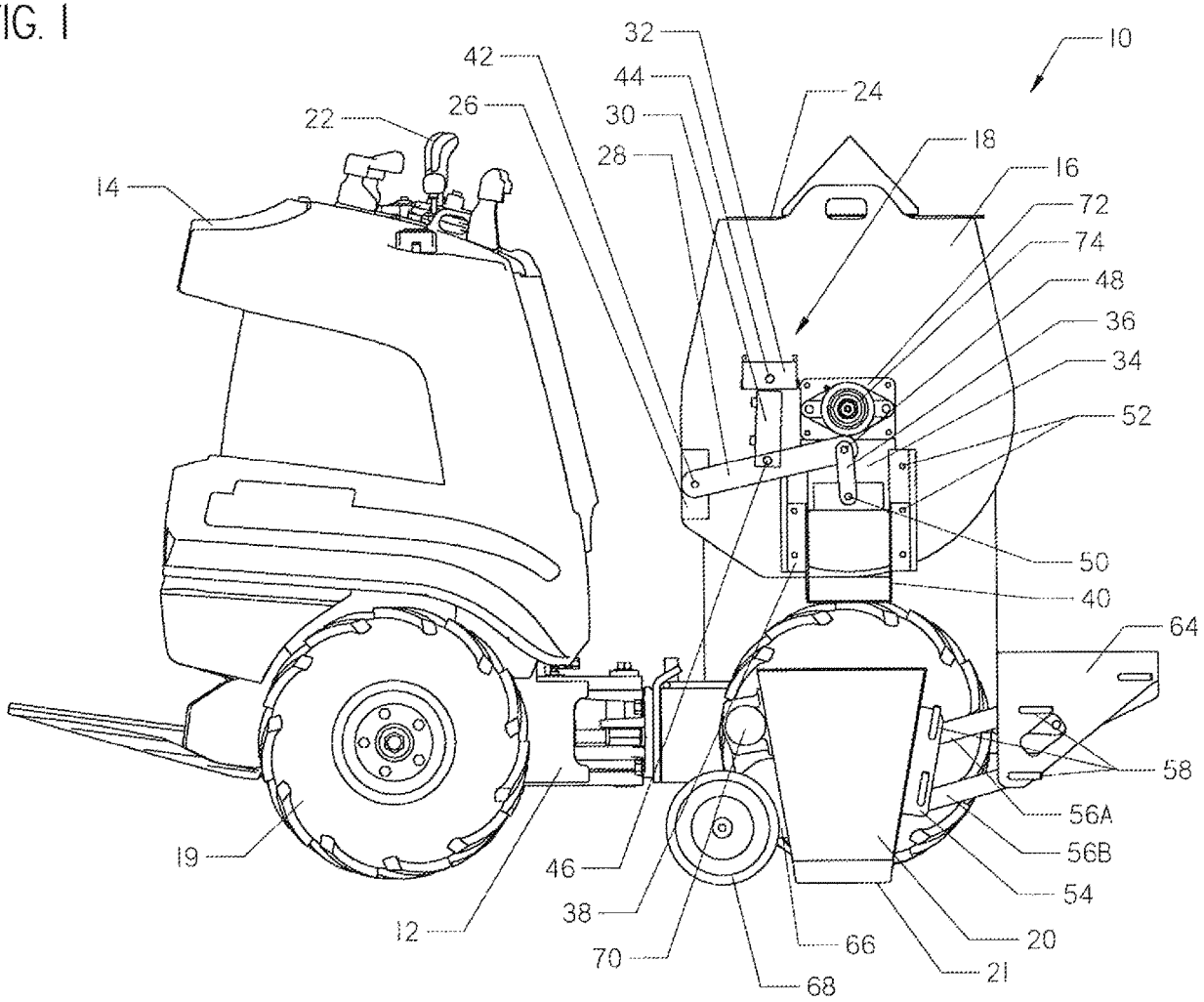
FIG. 1 is a side view of the trench filling machine of the present invention.

Traditionally micro-trenches are filled with grout or any other needed material by hand. The current invention allows the micro-trench to be filled using a machine that moves parallel to the trench as the trench is filled. Turning now to the drawings in general and FIG. 1 specifically, shown therein is a side view of the trench filling machine of the present invention. The trench filling machine designated generally by reference numeral 10 generally comprises a frame 12, an operator station 14, a tub 16, a release assembly 18, and a hopper 20. The trench filling machine 10 is operated and monitored with controls 22 located at the operator station 14. The frame 12 comprises a motive means 19 that works to transport the machine 10 to a desired location and move the machine 10 in line with the trench to be filled. The motive means 19 may comprise wheels or tracks.

The release assembly 18 is positioned on the first side 24 of the tub 16. The release assembly 18 works to release a material from the tub 16 and into the hopper 20. The material may comprise any material necessary to fill the trench. Preferably the material comprises a grout mixture. The release assembly 18 comprises a gate plate 26, a horizontal link 28, a cylinder 30, a cylinder mount 32, a door 34, a vertical link 36, a pair of door guides 38, and a spout 40. The gate plate 26 is attached to the first side 24 of the tub 16. The gate plate 26 serves as an anchor for the horizontal link 28 which is pivotally connected at its end to the gate plate 26 at pivot point 42.

The center of the horizontal link 28 is pivotally connected to cylinder 30 via a fastener 46. Cylinder 30 is in turn connected to cylinder mount 32. The cylinder mount 32 is attached to the first side 24 of the tub 16. The cylinder mount 32 serves as an anchor for the cylinder 30 and a piston (not shown) contained within the cylinder 30. The piston within the cylinder 30 connects to the cylinder mount 32 via a fastener 44. The cylinder 30 and corresponding piston function to move the horizontal link 28 up and down via extension and retraction of the piston in and out of the cylinder 30.

The opposing end of the horizontal link 28 not connected to the gate plate 26 is pivotally connected to vertical link 36 via a fastener 48. The movement of the horizontal link 28 up and down by cylinder 30 and the piston serves to move the door 34 and vertical link 36 up and down opening and closing door 34. The vertical link 36 is connected to the door 34 by a fastener 50. The vertical link 34 aids in opening and closing of door 34.

The movement of the door 34 up and down is stabilized by guides 38. The guides 38 attach to the first side 24 of the tub 16 via a plurality of fasteners 52. The guides 38 serve as a docking slip for the door 34 to slide up and down. The spout 40 is connected to the guides 38 using fasteners 52. The spout 40 extends out from the first side 24 of the tub 16 and over the hopper 20 forming a slide allowing the material to run out of the tub 16, down the spout 40, and into the hopper 20.

Continuing with FIG. 1, the hopper 20 is generally funnel shaped having an upper open end for receiving the material from the tub 16. The lower end of the hopper 20 includes a discharge conduit 21 which is joined to the upper main body portion of the hopper 20 at a relatively downward and forwardly directed angle. This allows the discharge conduit 21 of the hopper 20 to be inserted into the trench to be filled.

The hopper 20 is attached to the front portion of the frame 12 via a pivot plate 54 and lift arms 56A and 56B. The pivot plate 54 is attached to the front side of the hopper 20 and connects the lift arms 56A and 56B to the pivot plate via a pair of fasteners 58. The lift arms 56 work to move the hopper 20 in and out of the trench. Movement of the lift arms 56 is controlled by a hydraulic cylinder 60 (FIG. 3) and a lever 62 (FIG. 3) located behind the side plate 64 shown in FIG. 1.

On the opposite side of the hopper 20 from the pivot plate 54, a wheel mount 66 is attached to the hopper 20. A small wheel 68 is attached to the wheel mount 66 to help guide the hopper 20 along the trench when the hopper 20 is in its lowered position. The wheel 68 runs directly parallel with the open trench when the machine 10 is in operation.

The vibrator 70 is used to vibrate the entire hopper 20 to prevent material from being clogged in the discharge conduit 21 while a trench is being filled. The vibrator 70 may be attached to the side of the hopper 20 just above the wheel mount 66. The vibrator 70 also works to increase the rate of flow of the material through the discharge conduit 21 and into the open trench.

A mount plate 72 is also shown in FIG. 1 attached to the first side 24 of the tub 16 just above the guides 38. The mount plate 72 supports a bearing 74 which is used to support and allow rotation of the shaft 90 (FIG. 4) within the tub 16.

Figure 2:
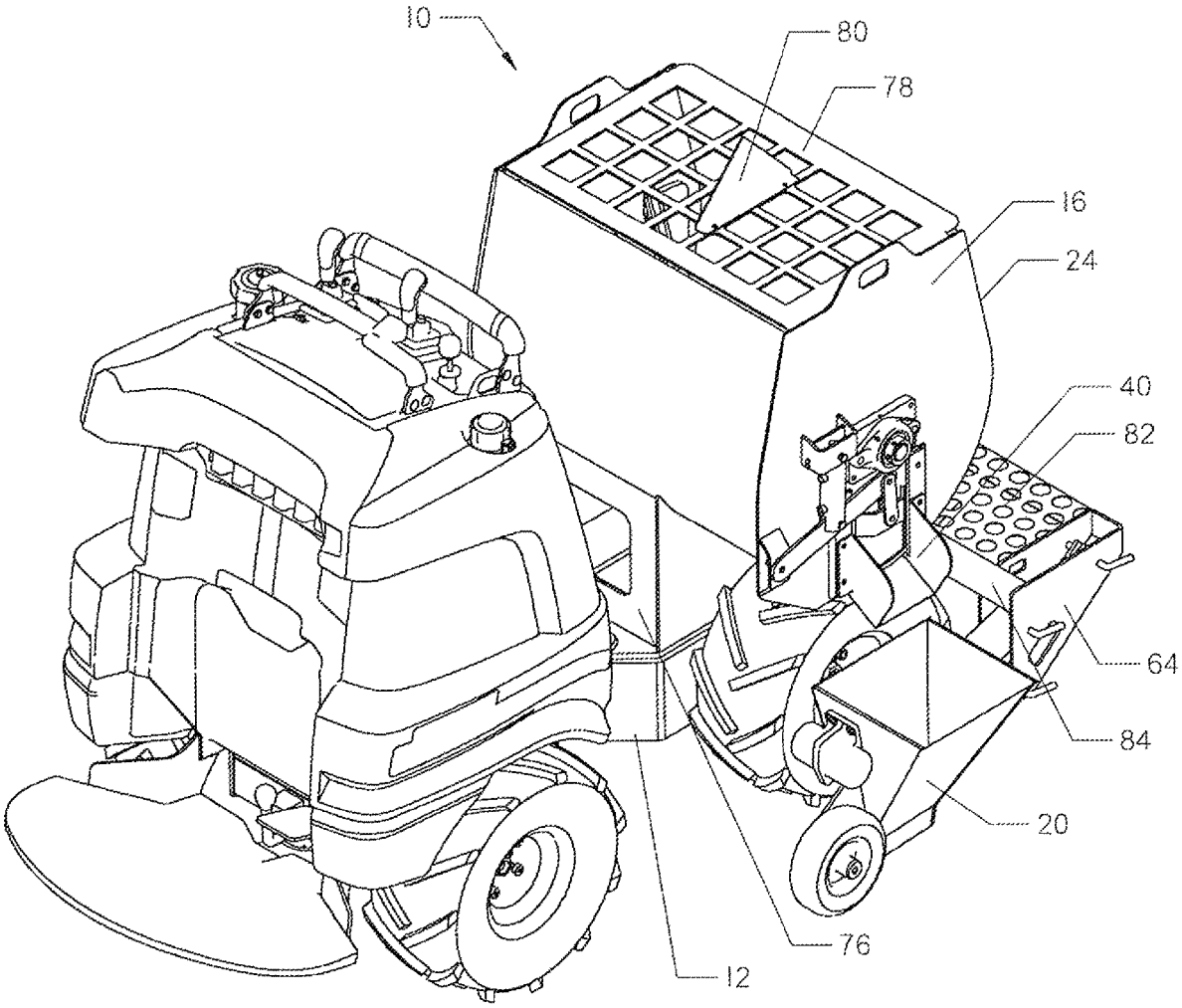
FIG. 2 is a perspective back view of the trench filling machine of FIG. 1.

Turning now to FIG. 2, a perspective back view of the trench filling machine 10 is shown. The tub 16 is supported and stabilized on the frame 12 via a brace 76. The brace 76 is contoured to allow the round bottom portion of the tub 16 to sit within it. The sides of the brace 76 are then attached to the sides of the tub 16 and the base of the brace 76 is attached to the motorized frame stabilizing the tub 16 while the machine 10 is in operation.

The top of the tub 16 is covered by a grate 78 which allows access to the inside of the tub 16 while at the same time protecting the material from debris. A bag cutter 80 is mounted on the top of the grate 78 for convenience in opening bags of material to pour into the tub 16.

A platform 82 is also shown attached to the front of the frame 12. The platform 82 aids in preparing and attending to the contents of the tub 16. A tube 84 is attached to the platform 82 and the side plate 64 to support the frame 12 and platform 82. A different view of the spout 40 is also shown in FIG. 2 depicting more clearly how the spout functions as a slide to move the material from the tub 16 to the hopper 20.

Figure 3:
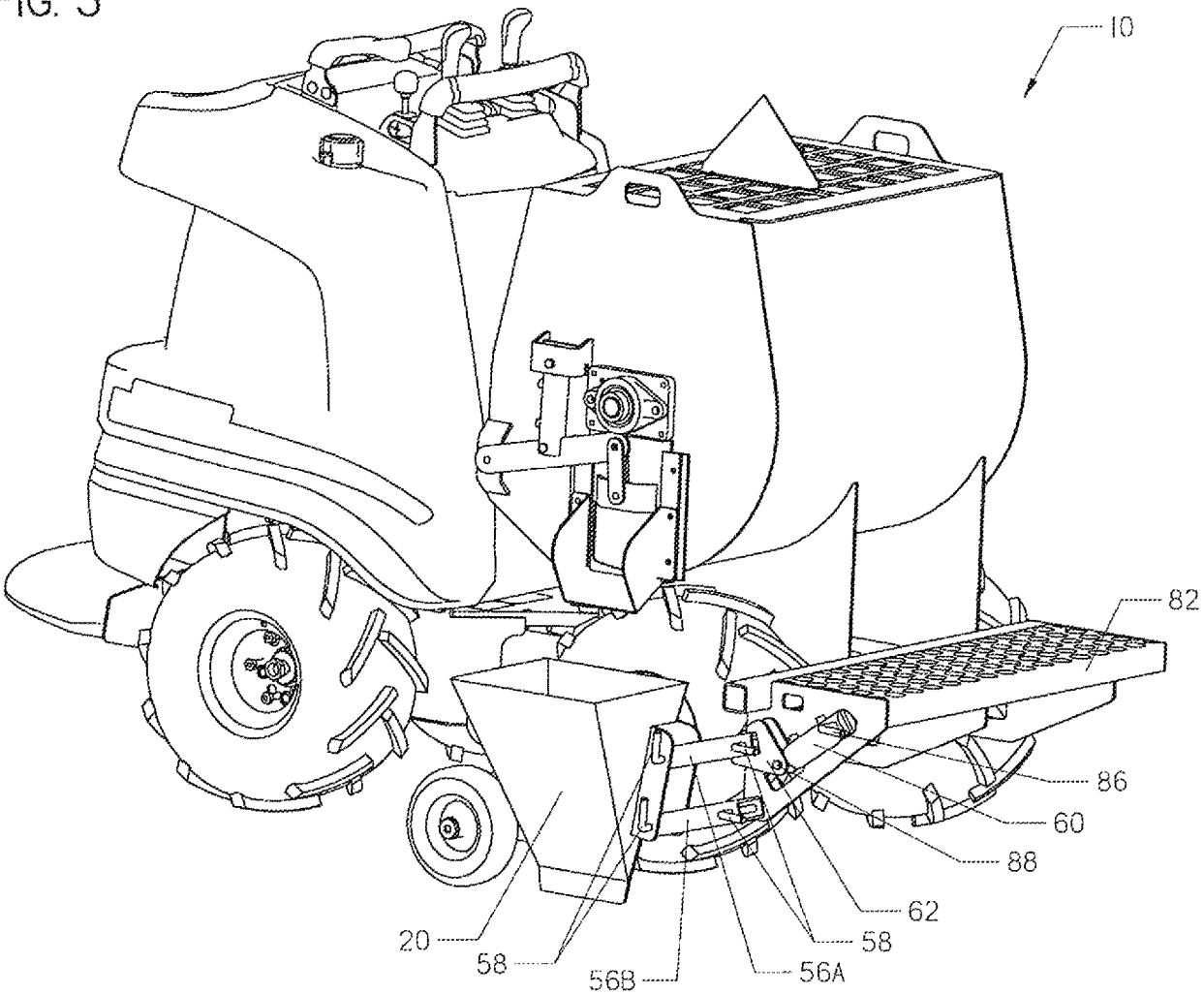
FIG. 3 is a perspective front view of the trench filling machine.

Turning now to FIG. 3, a side view of the machine 10 is shown with the side plate 64 (FIG. 2) removed exposing the cylinder 60 and lever 62. The cylinder 60 is pivotally connected to the side of the platform 82 via a fastener 86. The opposite end of the cylinder 60 is pivotally connected to the lever 62 via a fastener 88. Contained within the cylinder 60 is a piston (not shown) which may be extended and retracted, in turn pushing and pulling on the lever 62.

The forces exerted on the lever 62 by the piston and cylinder. 60 work to manipulate the lift arms 56A and 56B up and down through movement of the lever 62. The lever 62 is pivotally attached to lift arm 56A using fasteners 58 and lift arm 56B is also pivotally attached to the side of the platform 82 using fasteners 58. Movement of the lift arms 56A and 56B up and down works to move the hopper 20 in and out of the trench.

Figure 4:
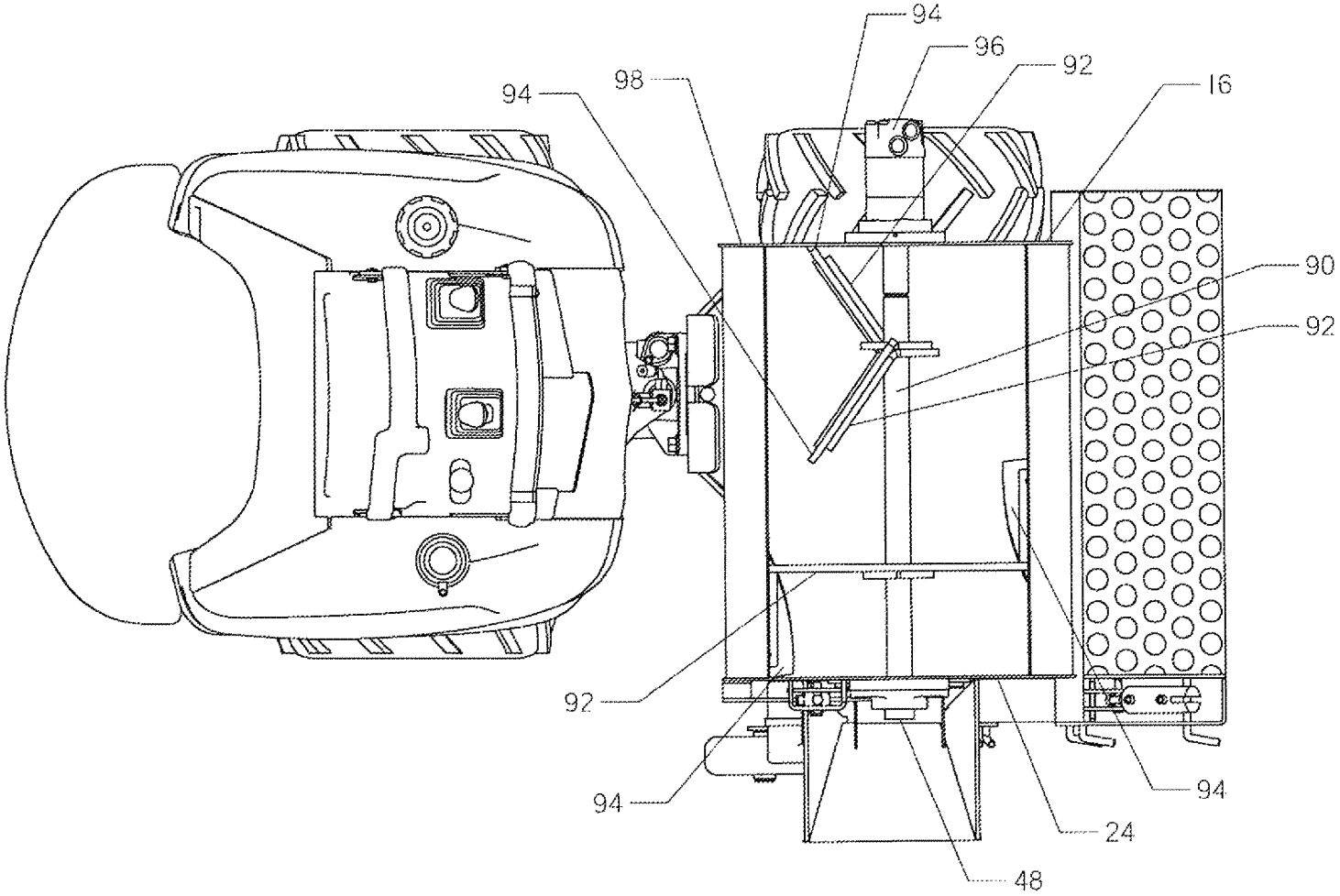
FIG. 4 is a top view of the trench filling machine.

Turning now to FIG. 4, a top view of the trench filling machine is shown with the top grate 78 (FIG. 2) of the tub 16 removed exposing the interior of the tub. The shaft 90 runs lengthwise through the center of the tub 16. Attached to the shaft 90 are blades 92 which work to stir the material inside the tub 16. Attached to the blades 92 are rubber paddles 94 which work to scrape material from the insides of the tub 16 while the blades 92 are stirring the mixture.

A motor 96 is attached to a second side 98 of the tub 16. The motor 96 connects to the shaft 90 inside the tub 16 and spins the shaft 90 which in turn spins the blades 92 and paddles 94. The shaft 90 is connected on its opposite side to the bearing 48 located on the first side 24 of the tub 16. The motor 96 continually spins the shaft 90 throughout the trench filling process to mix the material and move it toward door 34 (FIG. 1).

Figure 5:
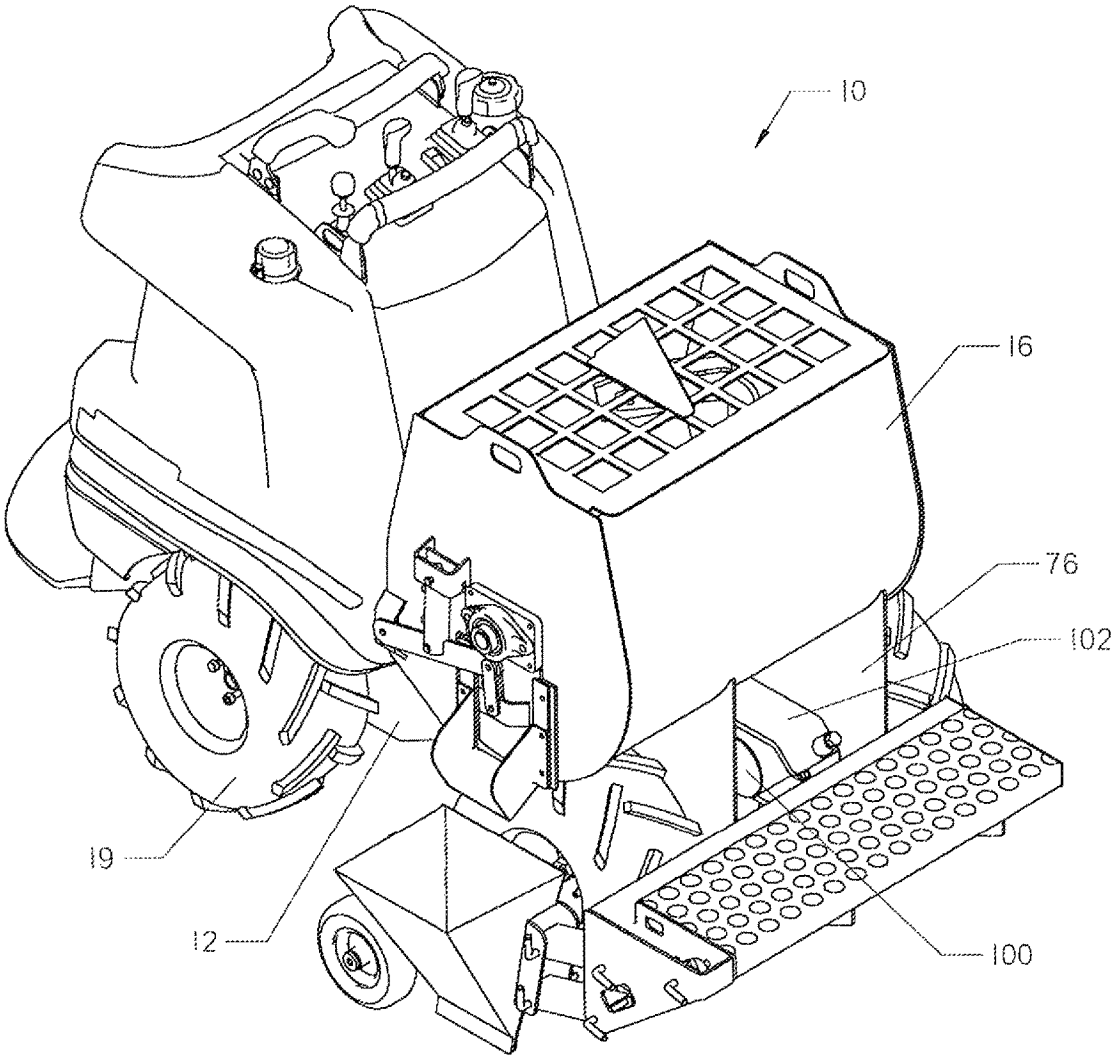
FIG. 5 is perspective front view of the trench filling machine.

Turning finally to FIG. 5, a front perspective view of the trench filling machine 10 is shown. A hydraulic motor 100 is shown beneath brace 76. The hydraulic motor 100 works to power the motive means 19 on the frame 12 in operation. An attachment plate 102 is also shown which connects the tub 16 to the frame 12.

Figure 6:
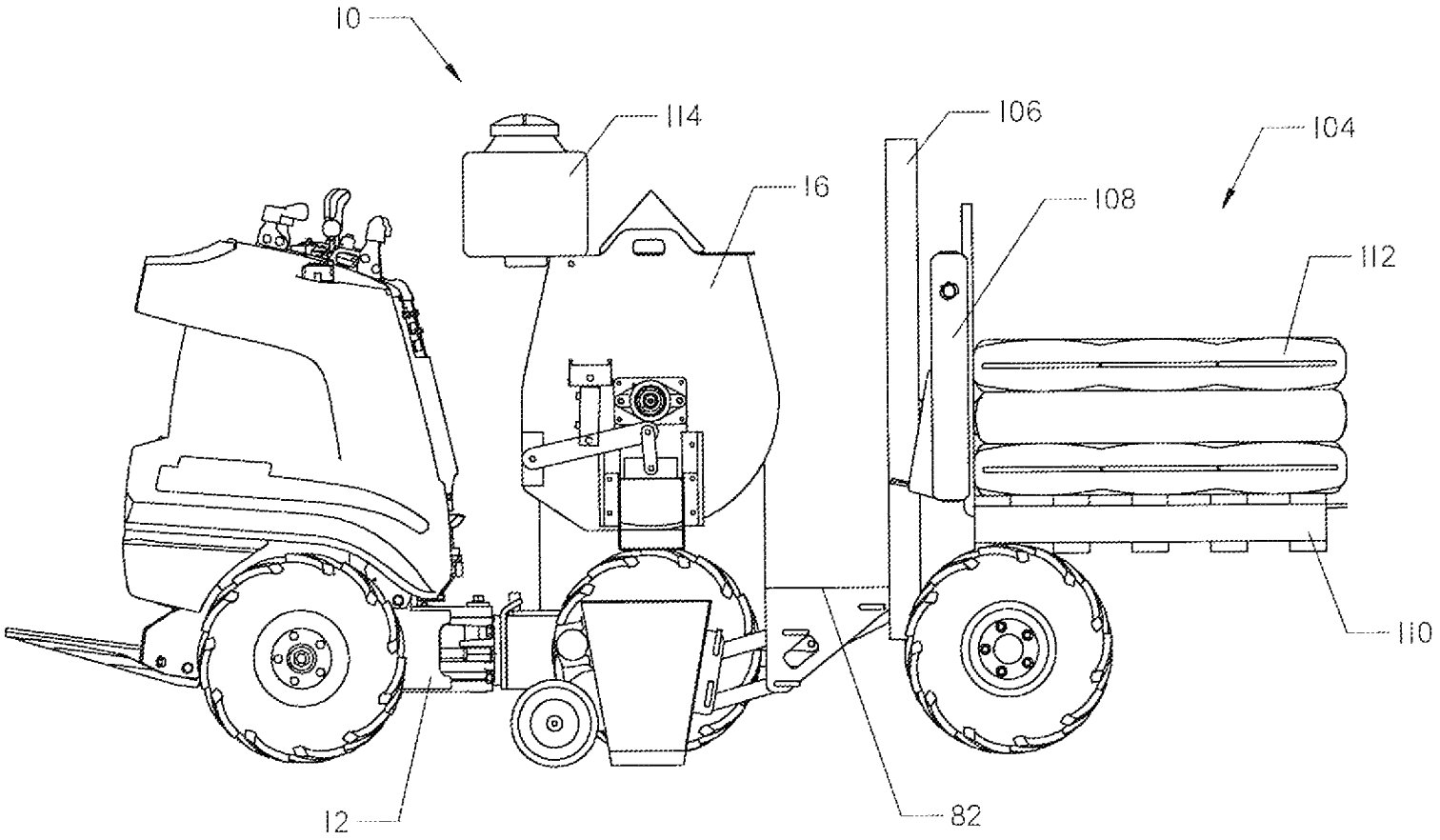
FIG. 6 is a side view of the trench filling machine having a carriage assembly.

Referring now to FIG. 6, a side view of an alternative embodiment of the trench filling machine 10 is shown with additional features. Attached to the front of the machine 10 is a carriage assembly 104. The carriage assembly 104 comprises a support 106, a hydraulic forklift 108, and a pallet 110. The support 106 is attached to the platform 82. The hydraulic forklift 108 is attached to the support 106 and is capable of moving up and down carrying a plurality of bags of material 112. The bags of material 112 rest on pallet 110 which slides on the forks (not shown) of hydraulic lift 108. Also, shown in FIG. 6 is a container 114 connected to the top of the tub 16 for holding water or other liquids used to mix with the material. Transporting liquids and additional bags of material with the machine 10 as it moves makes it more convenient to mix additional material. Material can be mixed right at the machine 10 rather than having to transport the machine 10 back to where additional mixing materials are located.

In operation, material is poured into the tub 16 with a mixing solution, such as water, and mixed together via the blades 92 spinning on the shaft 90. The trench filling machine 10 is positioned parallel to the trench to be filled. The hopper 20 is placed over the open trench such that the hopper 20 may be positioned within the trench at a desired depth allowing the wheel 68 to rest on the ground parallel to the trench.

The hopper 20 is moved via the lift arms 56A and 56B and cylinder 60 as shown in FIG. 3. When the cylinder 60 extends the piston (not shown) which pushes against lever 62, the lift arm 56A is forced upward moving lift arm 56B upward and moving the hopper 20 closer to the spout 40. When the piston is fully retracted inside the cylinder 60, the lift arms 56 are forced down moving the hopper 20 into the open trench. FIG. 3 shows the hopper 20 in the lowered position.

Once the hopper 20 is positioned in the trench as desired, the release assembly 18 can begin to release material into the hopper 20. The door 34 is in the closed position sealing off any material from exiting the tub 16 when the piston (not shown) within the cylinder 30 is extended. The piston extends from cylinder mount 32 from which it is connected. To open the door 34 the piston retracts into the cylinder 30 pulling the horizontal link 28 upwards which in turn pulls the door 34 upwards. Once the door 34 begins to open, the material is free to flow out of the door 34, down the spout 40, and into the hopper 20. When the hopper 20 is filled to the desired amount, the piston is extended from the cylinder 30 pushing the horizontal link 28 downwards and in turn pushing the door 34 downwards until it is closed.

Upon pouring the material into the hopper 20, the material begins to flow downward and pass out the discharge conduit 21 of the hopper 20 and into the trench. The vibrator 70 vigorously vibrates the hopper 20 to prevent material from clogging the conduit of the hopper 20 or from being stuck to the sides of the hopper 20. The vibrator 70 also helps to increase the rate of flow of the material from the hopper 20 into the trench to be filled.

The trench filling machine 10 is driven alongside the trench via the operator station 14 and the motive means 19. The material flows from the hopper 20 in the trench as the machine 10 moves. The trench filling machine 10 allows the operator to place materials in the trenches by operating the controls 22 at the operator station 14. Keeping the material in the hopper 20 separate from the material contained in the tub 16, allows the operator to take a break once the hopper 20 has been emptied without worry of the material within the tub 16 hardening.

Although the present invention has been described with respect to preferred embodiment, various changes and modifications may be suggested to one skilled in the art, and it is intended that the present invention encompass such changes and modifications as fall within the scope of this disclosure.

What is claimed is:

1. A trench filling machine, comprising:

a frame;

a plurality of ground-contacting motive elements for moving the frame on a ground surface;

a mixing vessel supported by the frame;

a hopper supported by the frame and having a discharge conduit;

a ground-engageable guide wheel supported by the hopper;

a transfer system configured to move material from the mixing vessel to the hopper; and a positioning system configured to selectively move the discharge conduit above and below the lowermost level of the ground-engageable guide wheel.

2. The trench filling machine of claim 1 in which the plurality of motive elements move the frame along a path, and in which the hopper is laterally offset from the path of the frame.

3. The trench filling machine of claim 1 in which the positioning system moves the hopper relative to the frame.

4. The trench filling machine of claim 1 in which the mixing vessel has an upper opening, and further comprises a grate supported by the mixing vessel and positioned over the opening.

5. The trench filling machine of claim 4 further comprising a cutting implement supported by the grate.

6. The trench filling machine of claim 1 in which the ground-engageable guide wheel is positioned on the opposite side of the discharge conduit from the frame while the ground-engageable guide wheel is in ground contact.

7. The trench filling machine of claim 1 in which the discharge conduit projects externally from the hopper and is narrowed in size relative to the hopper.

8. The trench filling machine of claim 1 further comprising an operator station supported by the frame and having controls for the machine, wherein the mixing vessel is positioned ahead of the operator station with respect to forward movement of the frame on the ground surface.

9. The trench filling machine of claim 1 comprising a vibrator supported by the hopper.

10. The trench filling machine of claim 1 in which the positioning system comprises a lift arm connected to the frame and the hopper.

11. The trench filling machine of claim 1 further comprising:

a rotatable shaft disposed within the mixing vessel;

a blade attached to the rotatable shaft; and a paddle attached to the blade to scrape a material from the mixing vessel when the shaft is rotated.

12. The trench filling machine of claim 1 in which the discharge conduit has walls that are immovable relative to one another.

13. The trench filling machine of claim 1 in which the discharge conduit is not enclosed by any other structure of the machine.

14. The trench filling machine of claim 8 in which controls for the positioning system are situated at the operator station.

* * * * *